US011065736B2

(12) United States Patent
Napper

(10) Patent No.: US 11,065,736 B2
(45) Date of Patent: Jul. 20, 2021

(54) TOTE TRAY

(71) Applicant: Nap Tools Limited, Exeter (GB)

(72) Inventor: Ryan Napper, Exiter (GB)

(73) Assignee: NAP TOOLS LIMITED, Exeter (GB)

( * ) Notice: Subject to any disclaimer, the term of this patent is extended or adjusted under 35 U.S.C. 154(b) by 110 days.

(21) Appl. No.: 16/048,401

(22) Filed: Jul. 30, 2018

(65) Prior Publication Data

US 2020/0030943 A1 Jan. 30, 2020

(51) Int. Cl.
*B25B 5/14* (2006.01)
*B25H 3/06* (2006.01)

(52) U.S. Cl.
CPC ..... *B25B 5/147* (2013.01); *B25H 3/06* (2013.01)

(58) Field of Classification Search
CPC ..... B25B 5/147; B25H 3/06
See application file for complete search history.

(56) References Cited

U.S. PATENT DOCUMENTS 3,107,636 A 10/1963 Knight
3,731,818 A * 5/1973 Young ..... A47B 81/005 206/317
3,851,756 A * 12/1974 Brown ..... B25H 1/04 206/216
4,747,490 A * 5/1988 Smith ..... A45C 11/20 206/542
4,815,593 A * 3/1989 Brown ..... B60R 7/04 206/315.11
4,907,778 A * 3/1990 Rockwell ..... B23D 63/003 24/327
5,735,413 A 4/1998 Allen
5,938,023 A * 8/1999 Herron ..... B25H 3/023 206/315.11
6,370,810 B1 * 4/2002 Widerman ..... A01K 97/10 24/16 PB
6,375,115 B1 * 4/2002 Reed ..... B25H 3/02 206/389
6,910,429 B1 6/2005 Matay et al.
7,891,618 B2 * 2/2011 Carnevali ..... A47B 21/0314 248/228.5
9,539,722 B2 * 1/2017 Martinez ..... B25H 3/02
(Continued)

FOREIGN PATENT DOCUMENTS

GB 2556889 6/2018
WO 2012/175726 12/2012

*Primary Examiner* — Joseph J Hail
*Assistant Examiner* — J Stephen Taylor
(74) *Attorney, Agent, or Firm* — Crose Law LLC; Bradley D. Crose

(57) ABSTRACT

Plumbers are often required to carry out various tasks on water pipes including measuring, cutting, bending, threading, joining, soldering and marking positions on pipes. Each of these activities requires the pipe to be held securely by the plumber (for instance in one hand, or under one foot, while the task itself is carried out using the free hand(s). The present invention is a tote tray provided with a clamp 15 connected to the open-top box, the clamp configured for releasably gripping a pipe 17. In this way, a plumber may place a pipe 17 within the clamp 15 and securely grip it therein, and may then carry out various types of work on the pipe 17 without the need to hold the pipe 17 manually in position. Once work on the pipe 17 has been completed, the user may release the clamp's grip on the pipe 17.

7 Claims, 3 Drawing Sheets

(56) References Cited

U.S. PATENT DOCUMENTS

| | | | | |
|---|---|---|---|---|
| 10,300,594 | B2 * | 5/2019 | Hartsock | B25H 3/02 |
| 10,548,685 | B2 * | 2/2020 | Gibbs | A61B 50/15 |
| 2011/0079947 | A1 * | 4/2011 | Masters | B25H 1/12 269/296 |
| 2011/0222274 | A1 * | 9/2011 | Ko | F21V 21/08 362/191 |
| 2015/0164221 | A1 | 6/2015 | Zimmerman | |

* cited by examiner

TOTE TRAY

FIELD OF THE INVENTION

The present invention relates to tote trays and a method of securely holding a pipe, and find particular, although not exclusive, utility for plumbers.

BACKGROUND OF THE INVENTION

Tote trays are routinely used by tradespersons of various different kinds, including plumbers, and are used for carrying tools and items of equipment such as pipe cutters, blow torches, solder, soldering irons, pliers, pipe benders, etc. Tote trays typically comprise an open-top box/container and/or relatively high-sided tray into which items may be placed. The tote tray is often formed of a plastics material, for instance including a handle moulded into the tray. The handle is usually centrally located, acting to divide the open-top box/container into two regions either side thereof.

Plumbers are often required to carry out various tasks on water pipes including measuring, cutting, bending, threading, joining, soldering and marking positions on pipes. Each of these activities requires the pipe to be held securely by the plumber (for instance in one hand, or under one foot, while the task itself is carried out using the free hand(s).

BRIEF SUMMARY OF THE INVENTION

According to a first aspect of the present invention, there is provided a tote tray for storage of tools therein, the tote tray comprising: an open-top box for the storage of tools therein, the open-top box comprising a handle for a user to carry the open-top box; a clamp connected to the open-top box, the clamp configured for releasably gripping a pipe; and a silicone pad connected to the open-top box and arranged such that a straight length of pipe gripped by the clamp abuts the silicone pad.

In this way, a plumber may place a pipe within the clamp and securely grip it therein, and may then carry out various types of work on the pipe without the need to hold the pipe manually in position. Once work on the pipe has been completed, the user may release the clamp's grip on the pipe.

The clamp may comprise a pair of opposed jaws configured to accept a pipe having a diameter at least between 5 mm and 50 mm; in particular, at least between 8 mm and 40 mm; more particularly at least between 10 mm and 28 mm.

The pair of opposed jaws may comprise a fixed jaw and a movable jaw. Alternatively, the pair of opposed jaws may comprise a pair of movable jaws. The or each movable jaw may be resiliently biased, for instance with a torsion spring, leaf spring or any other appropriate spring. The or each movable jaw may be biased together, for instance to grip a pipe therein, or may be biased apart.

Alternatively or additionally, the clamp may be manually tightenable, for instance by screwing, and/or the clamp may comprise a clip for locking the clamp in a closed position.

At least one of the jaws may comprise a guide to enable alignment of a pipe therein. The guide may comprise a groove and or one or more rails.

Each jaw may be configured to accept only one pipe at a time or more than one pipe at a time, for instance two pipes at the same time. The clamp may comprise only one pair of opposed jaws or more than one pair of opposed jaws, for example two pairs of opposed jaws. The tote tray may comprise only one clamp or more than one clamp, for example two clamps.

The clamp may be disposed adjacent to the handle. For instance, the clamp may be disposed substantially beneath the handle. Alternatively or additionally, the clamp may be disposed adjacent to a rim of the open-top box.

The silicone pad may enable the pipe to be held by frictional forces at second place along its length to prevent twisting of the pipe within the clamp. The silicone pad may be substantially resilient. The silicone pad may be configured to limit thermal transfer from a pipe lying thereon to the open-top box.

The silicone pad may be disposed adjacent to a rim of the open-top box. For instance, the silicone pad may be disposed on the rim. Alternatively or additionally, the silicone pad may be disposed adjacent to the handle.

The silicone pad may be spaced from the clamp, for instance by a distance substantially equal to a width of the box or a distance substantially equal to half a width of the box.

The silicone pad may be disposed on an upper surface of the box, for instance an upper rim of the box. The silicone pad may be configured to wrap around a rim of the box, such that the silicone pad extends at least partially down an inside and/or outside portion of the box from the upper rim.

The silicone pad may comprise only one silicone pad or more than one silicone pad, for example two silicone pads. In particular, a single silicone pad may extend such that, if two pipes are gripped at the same time by the jaws as described above, each pipe abuts the silicone pad. Alternatively, if two pipes are gripped at the same time by the jaws as described above, each pipe may abut a respective silicone pad.

According to a second aspect of the present invention, there is provided a method of securely holding a pipe, the method comprising the steps of: providing a tote tray according to any preceding claim; providing a pipe; placing the pipe within the clamp such that it abuts the silicone pad; and activating the clamp to grip the pipe therein.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

DETAILED DESCRIPTION OF THE INVENTION

Figure 1:
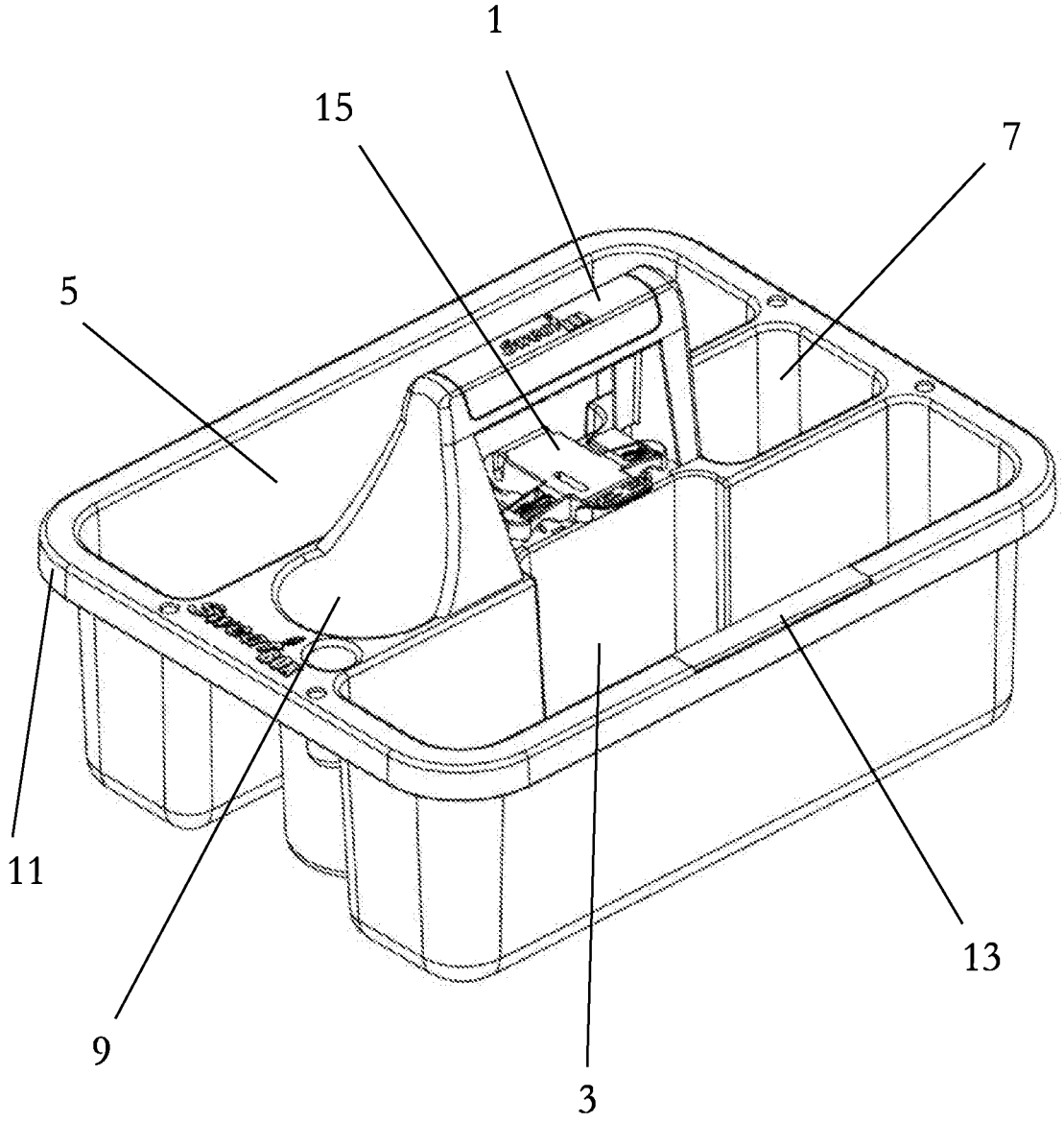
FIG. 1 is a perspective view of a tote tray.

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1 is a perspective view of a tote tray having a centrally disposed handle 1, around which are provided four regions in which items may be held: a first elongate region 3 on a first side of the handle, a second elongate region 5 arranged a second side opposite the first side, and a square region 7 and a circular region 9 disposed between the first and second elongate regions, each on a respective third and fourth side of the handle (the third side opposing the fourth side). The circular region 9 is configured to receive a blow torch/gas canister therein.

A lip 11 runs around a perimeter of the tote tray, upon which on the first side of the handle is disposed a silicone strip 13.

Beneath the handle 1 is provided a clamp 15 in the form of a sprung clip. The clip has a pair of arms, each arm for gripping a respective pipe against an upper surface of the tote tray.

The clamp 15 and silicone strip 13 are mutually configured and arranged such that pipes gripped by the clamp 15 are orientated to lie on the silicone strip 13.

Figure 2:
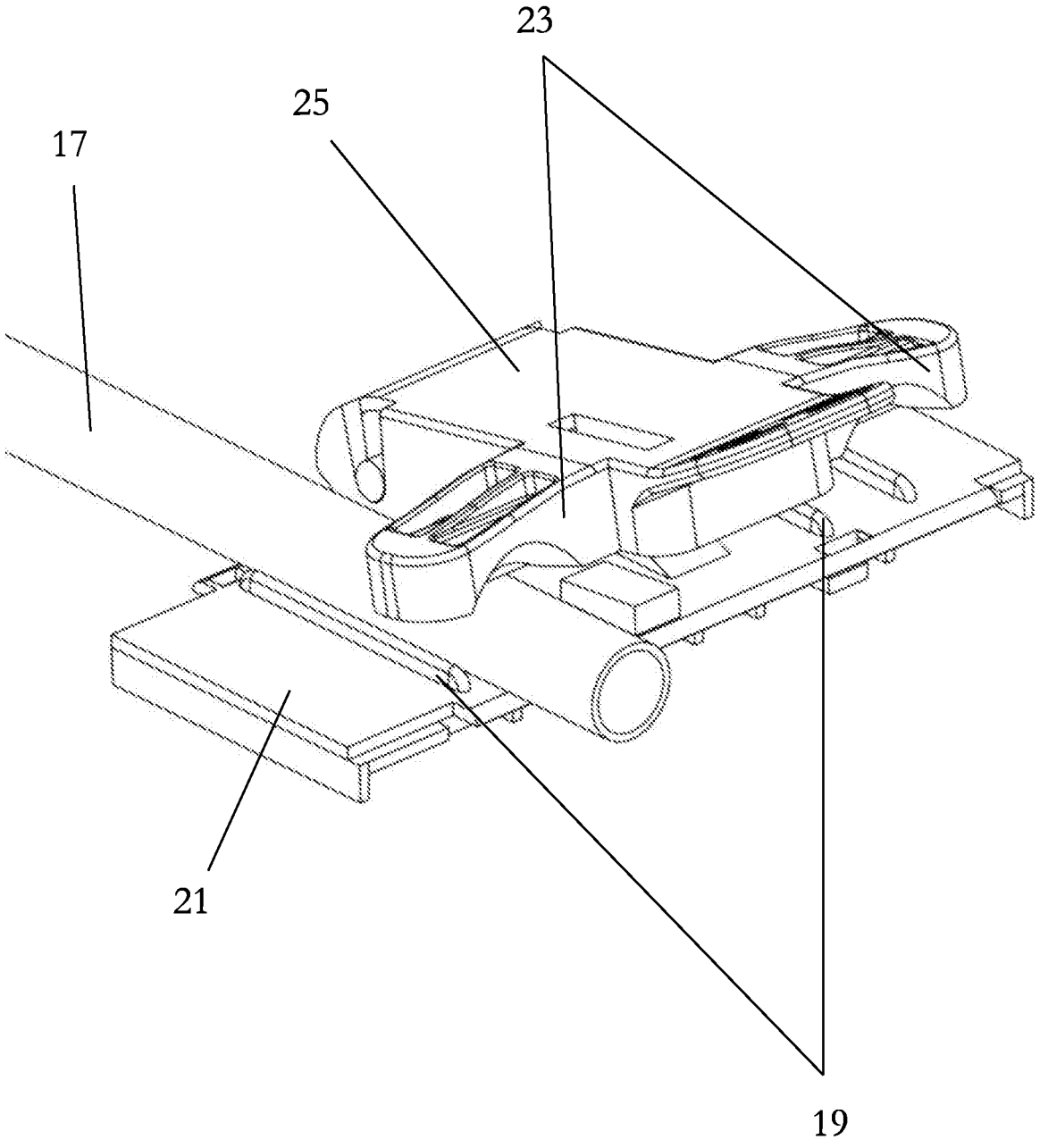
FIG. 2 is a perspective view of a clamp for use in the tote tray of FIG. 1, shown with a pipe therein.

FIG. 2 is a perspective view of a clamp 15 for use in the tote tray of FIG. 1, shown with a pipe 17 therein.

Rails 19 are provided on a horizontal surface 21 to align the pipe 17 beneath a respective arm 23. The arm is shaped to receive the pipe 17 therein, by having an approximately semi-cylindrical recess therein.

The arms 23 are connected together by a pivotable body 25 that may be manipulated manually by a user to release the pipe 17.

Figure 3:
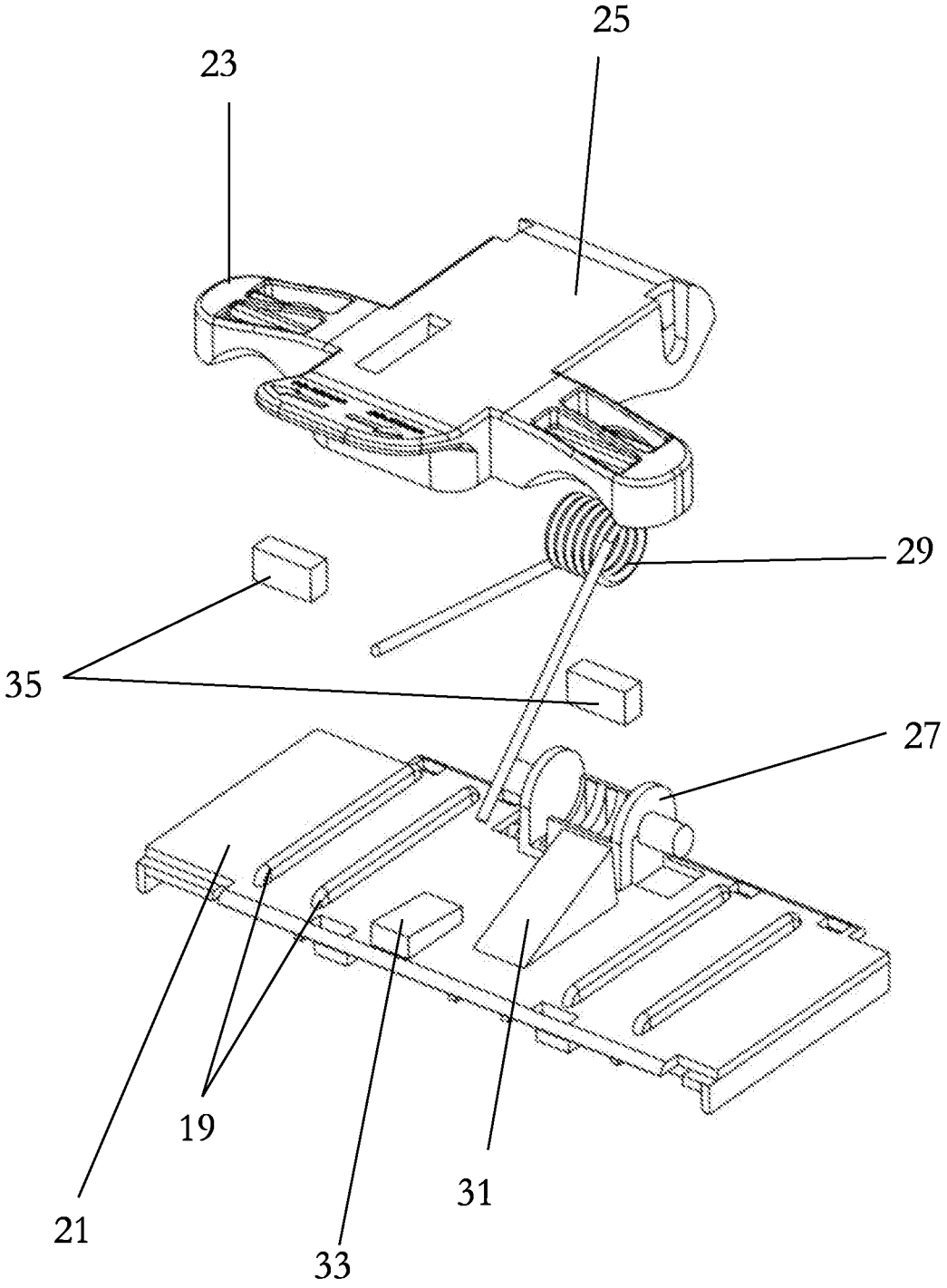
FIG. 3 is an exploded perspective view of the clamp of FIG. 2.

FIG. 3 is an exploded perspective view of the clamp 15 of FIG. 2 showing the substantially flat surface 21, upon which are provided four substantially parallel rails 19, each pair of rails 19 arranged to receive a pipe therebetween.

Projecting upwardly from the surface 21 is a pivot mount 27 upon which the pivotable body 25 may be mounted. A hollow within the centre of the pivot mount 27 is configured to receive a torsion spring 29 therein. Respective legs of the torsion spring couple to the surface 21 (for instance via ramp 31) and to the body 25. The torsion spring is configured to bias the body 25 into contact with the surface 21. A stop 33 is provided on the surface 21 to prevent over-clamping of pipes beneath the arms 23.

Resilient pads 35 are provided to be inserted beneath the arms 23 to provide effective gripping of pipes held thereunder.

The invention claimed is:

1. A tote tray for storage of tools therein, the tote tray comprising:

an open-top box for the storage of tools therein, the open-top box comprising a handle for a user to carry the open-top box;

a clamp connected to the open-top box, the clamp configured for releasably gripping a pipe at a first location along the open-top box; and a silicone pad disposed, in use, on and directly connected to an upper surface of the open-top box and arranged such that a straight length of pipe gripped by the clamp is oriented to abut the silicone pad at a second location, along the upper surface of the open-top box, spaced from the clamp.

2. The tote tray of claim 1, wherein the clamp comprises a pair of opposed jaws configured to accept a pipe having a diameter at least between 5 mm and 50 mm.

3. The tote tray of claim 2, wherein the pair of opposed jaws comprise a fixed jaw and a movable jaw, the movable jaw being resiliently biased to grip a pipe therein.

4. The tote tray of claim 1, wherein the clamp is disposed adjacent to the handle.

5. The tote tray of claim 1, wherein the silicone pad is disposed adjacent to a rim of the open-top box.

6. The tote tray of claim 5, wherein the silicone pad is configured to wrap around a rim of the box, and extend at least partially down an inside and/or outside portion of the box from the upper rim.

7. A method of securely holding a pipe, the method comprising the steps of:

providing a tote tray comprising:

an open-top box for the storage of tools therein, the open-top box comprising a handle for a user to carry the open-top box;

a clamp connected to the open-top box, the clamp configured for releasably gripping a pipe at a first location along the open-top box; and a silicone pad disposed, in use, on and directly connected to an upper surface of the open-top box and arranged such that a straight length of pipe gripped by the clamp is oriented to abut the silicone pad at a second location, along the upper surface of the open-top box, spaced from the clamp;

providing a pipe;

placing the pipe within the clamp such that it abuts the silicone pad; and activating the clamp to grip the pipe therein.

* * * * *